US006918660B2

(12) United States Patent
Takahashi

(10) Patent No.: US 6,918,660 B2
(45) Date of Patent: Jul. 19, 2005

(54) INK EJECTING DEVICE

(75) Inventor: Yoshikazu Takahashi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 45 days.

(21) Appl. No.: 10/423,181

(22) Filed: Apr. 25, 2003

(65) Prior Publication Data

US 2003/0210304 A1 Nov. 13, 2003

(30) Foreign Application Priority Data

May 8, 2002 (JP) ..... 2002-132730

(51) Int. Cl.[7] ..... B41J 2/045
(52) U.S. Cl. ..... 347/71
(58) Field of Search ..... 347/54, 68, 70, 347/71

(56) References Cited

U.S. PATENT DOCUMENTS 5,215,446 A 6/1993 Takahashi et al.
6,284,147 B1 9/2001 Silverbrook
6,457,818 B1 * 10/2002 Kurashima et al. ..... 347/71
2001/0020968 A1 9/2001 Isono et al.

FOREIGN PATENT DOCUMENTS

JP 61137753 6/1986
JP 2001260347 A * 9/2001 ..... B41J/2/045

* cited by examiner

*Primary Examiner*—Anh T.N. Vo
(74) *Attorney, Agent, or Firm*—Reed Smith LLP

(57) ABSTRACT

A first cavity plate formed with a first pressure chamber and a second cavity plate formed with a second pressure chamber are disposed on both sides of a piezoelectric actuator. A pressure generating portion is formed between opposed surfaces of the piezoelectric actuator. The first pressure chamber faces one of the opposed surfaces of the piezoelectric actuator while the second pressure chamber faces the other surface. The first and second pressure chambers communicate with each other via inner and outer holes that penetrate the piezoelectric actuator. The pressure generating portion is deformable to expand to shift the opposed surfaces of the piezoelectric actuator toward the first and second pressure chambers and reduce the volume of the first and second pressure chambers. As a result, an ink droplet is ejected from a nozzle that communicates with both the first and second pressure chambers. Because the deformation of the piezoelectric actuator on both sides thereof is effectively used to eject ink, a drive voltage for the pressure generating portion can be reduced.

28 Claims, 14 Drawing Sheets

INK EJECTING DEVICE

BACKGROUND OF THE INVENTION

1. Field of Invention

The invention relates to an ink ejecting device, such as an ink-jet head of an ink-jet printer and, more specifically, to an ink ejecting device that effectively uses deformation of a piezoelectric actuator.

2. Description of Related Art

A piezoelectric ink ejecting mechanism has been conventionally proposed for a printhead. In the piezoelectric ink ejecting mechanism, a piezoelectric actuator deforms to change the volume of an ink chamber. Ink in the ink channel is ejected from a nozzle when the volume of the ink chamber is reduced, while ink is drawn into the ink channel when the volume of the ink chamber is increased. A plurality of such ink ejecting mechanisms are disposed adjacent to each other, and ink is selectively ejected from an ink ejecting mechanism at a particular position to form desired characters and images.

An ink-jet head using such a conventional piezoelectric ink ejecting mechanism is disclosed in U.S. patent application Publication No. 2001/0020968, which is incorporated herein by reference. FIG. 14 is an enlarged sectional view of a conventional piezoelectric ink-jet head as disclosed in that publication. The piezoelectric ink-jet head includes a cavity plate 100 formed by laminating piezoelectric sheets 110–140 and a piezoelectric actuator 200 formed by laminating thin metal plates 210–230. The cavity plate 100 is formed with a nozzle 150 open toward the outside, a pressure chamber 160 communicating with the nozzle 150, and a common ink chamber 120 that distributes ink from an ink source (not shown), through an ink supply hole 180, to the pressure chamber 160. The piezoelectric actuator 200 has a pressure generating portion 280 that applies pressure to the pressure chamber 160 for ink ejection.

The pressure generating portion 280 is defined between a drive electrode 240 and a common electrode 250 in a piezoelectric sheet 220 of the piezoelectric actuator 200, and is polarized in a direction from the drive electrode 240 toward the common electrode 250. When an electric field generated parallel to the polarization direction is applied to the pressure generating portion 280, the pressure generating portion 280 expands in a direction of the thickness of the piezoelectric actuator 200. The deformed piezoelectric actuator 200 reduces the volume of the pressure chamber 160 and pressurize the ink therein. As a result, an ink droplet is ejected from the nozzle 150 that communicates with the pressure chamber 160.

The pressure generating portion 280 expands toward the pressure chamber 160 as well as toward the opposite direction, which may cause a pressure loss. Due to such a pressure loss, a relatively high voltage is required for the pressure generating portion 280 to expand as required toward the pressure chamber 160, and thus the cost of a power supply system is increased.

Another problem arises when the piezoelectric ink-jet head is formed by stacking the piezoelectric actuator 200 made of piezoelectric ceramic and the cavity plate 100 made of metal. Because there is a big difference in the linear expansion coefficient between the piezoelectric ceramic and the metal, the piezoelectric actuator 200 and the cavity plate 100 are likely to bend at a different rate with temperature changes when they are bonded or used for printing. This may cause positional shifts of ink dots and degrade print quality.

SUMMARY OF THE INVENTION

The present invention addresses the foregoing problems and provides an ink ejecting device that effectively uses deformation of a pressure generating portion of a piezoelectric actuator to reduce a drive voltage required for the pressure generating portion and ultimately reduce the cost of a power supply system. The invention also provides an ink ejecting device that has a piezoelectric actuator and a cavity plate that are unlikely to bend with temperature changes when they are bonded or used for printing.

According to one aspect of the invention, an ink ejecting device includes a nozzle from which ink is ejected, an actuator having a pressure generation portion between its opposed surfaces, a first pressure chamber disposed to face one of the opposed surfaces of the actuator, and a second pressure chamber disposed to face the other surface of the actuator. The pressure generating portion is deformable to shift the opposed surfaces of the actuator substantially symmetrically to pressurize the ink stored in the first and second pressure chambers. The first and second pressure chambers communicate with each other and also communicate with the nozzle. The first and second pressure chambers may communicate with each other via a through-hole formed in the actuator and via a second through-hole formed in the actuator and leading to the nozzle. When the pressure generating portion deforms to shift two opposed surfaces of the actuator, the ink in the first pressure chamber flows toward the nozzle, and the ink in the second pressure chamber flows through the second through-hole toward the nozzle.

According to another aspect of the invention, an ink ejecting device includes a first cavity plate formed with a common ink chamber and a first pressure chamber, a second cavity plate formed with a second pressure chamber, an actuator disposed between the first and second cavity plates, a first ink passage, a second ink passage, and a nozzle. A deformable portion of the actuator is placed between the first and second pressure chambers. The ink in the common ink chamber is supplied to the first and second pressure chambers through the first ink passage. The ink flows from the first and second pressure chambers through the second ink passage to the nozzle.

BRIEF DESCRIPTION OF THE DRAWINGS

One embodiment of the invention will be described in detail with reference to the following figures, in which like elements are labeled with like numbers and in which.

DETAILED DESCRIPTION OF PREFERRED EMBODIMENT

Figure 1:
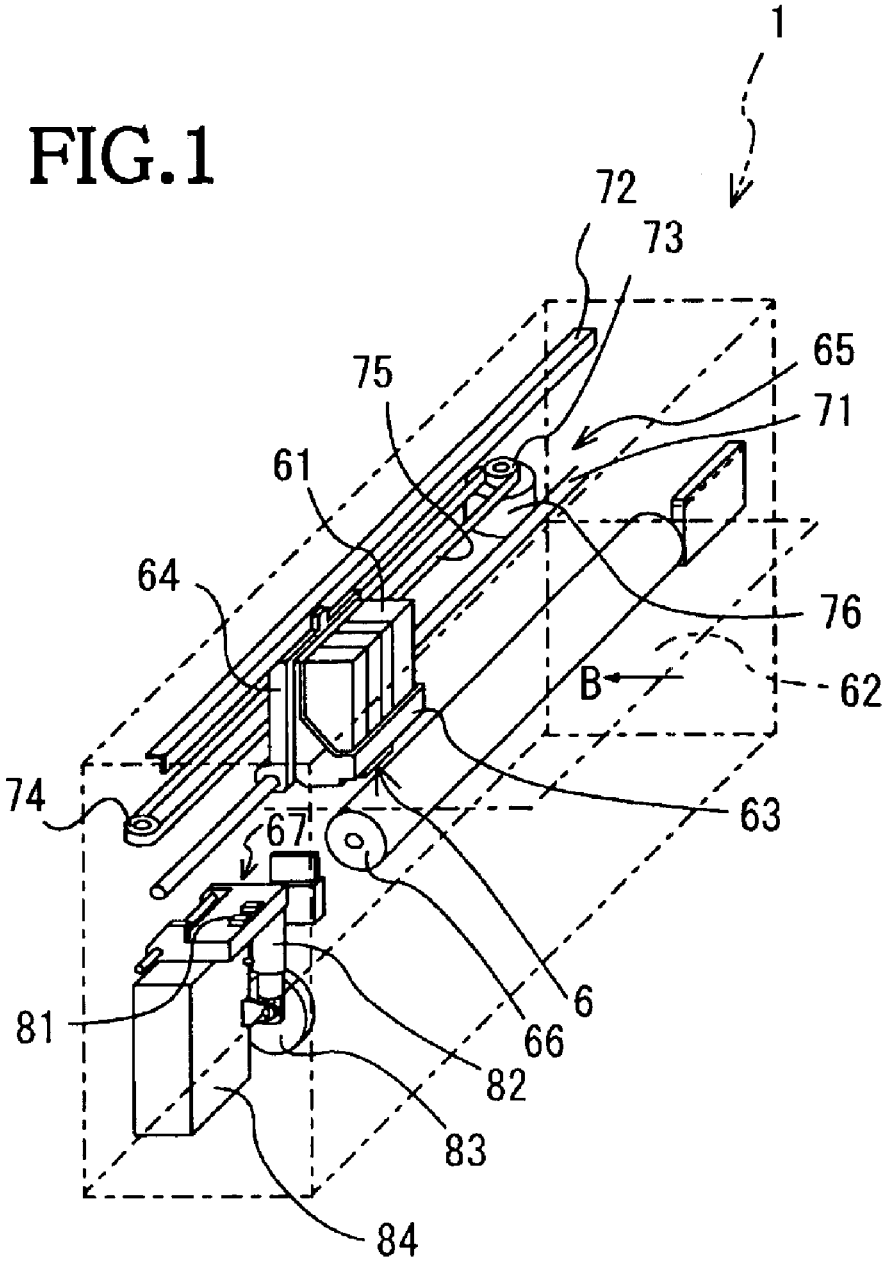
FIG. 1 is a perspective view of an ink-jet printer incorporating a piezoelectric ink-jet head according to the invention.

One embodiment of the invention applied to an ink-jet head will be described with reference to the attached figures. FIG. 1 is a perspective view of a color ink-jet printer 1 incorporating an ink-jet head according to the invention.

As shown in FIG. 1, the color ink-jet printer 1 includes ink cartridges 61 containing cyan, magenta, yellow, and black inks, respectively, a head unit 63 having piezoelectric ink-jet heads 6 that perform printing on a sheet of paper 62 fed in the direction of arrow B, and a carriage 64 on which the ink cartridges 61 and the head unit 63 are mounted. The color ink-jet printer 1 further includes a drive unit 65 that drives the carriage 64 to reciprocate perpendicularly to the sheet feeding direction, a platen roller 66 disposed to face the piezoelectric ink-jet heads 6 and extend along the carriage reciprocating direction, and a purge unit 67.

The drive unit 65 includes a carriage shaft 71 disposed at the lower end of the carriage 64 to extend parallel to the platen roller 66, a guide plate 72 disposed at the upper end of the carriage 64 to extend parallel to the carriage shaft 71, two pulleys 73, 74 disposed at both ends of the carriage shaft 71 to be sandwiched between the carriage shaft 71 and the guide plate 72, and an endless belt 75 looped over the pulleys 73, 74. When the pulley 73 is driven by a motor 76 to rotate forward and in reverse, the carriage 64 attached to the endless belt 75 reciprocates linearly along the carriage shaft 71 and the guide plate 72.

The sheet 62 is supplied from a sheet feed cassette (not shown) provided at one side of the color ink-jet printer 1, and is guided between the ink-jet heads 6 and the platen roller 66, where the ink-jet heads 6 eject ink to print a predetermined image on the sheet 62. Thereafter, the sheet 62 is discharged. A sheet feed mechanism and a sheet discharge mechanism are omitted from FIG. 1.

The purge unit 67 is disposed at one side of the platen roller 66 to face the ink-jet heads 6 when the head unit 63 is in the reset position. The purge unit 67 includes a cap 81 that contacts and covers the nozzles of the ink-jet heads 6, a pump 82, a cam 83, and an ink tank 84. When the head unit 63 is in the reset position, the nozzles of each ink-jet head 6 is covered with the cap 81, and the purge unit 67 sucks defective ink containing air bubbles from the ink-jet head 6 using the pump 82 driven by the cam 83. As a result, the ink-jet head 6 is restored to the operable state. Sucked ink is discharged into the ink tank 84. Purging operation prevents poor ink ejection that is caused by the ink or bubbles trapped in the ink-jet head 6 when ink is initially supplied to the ink-jet head 6.

Figure 2:
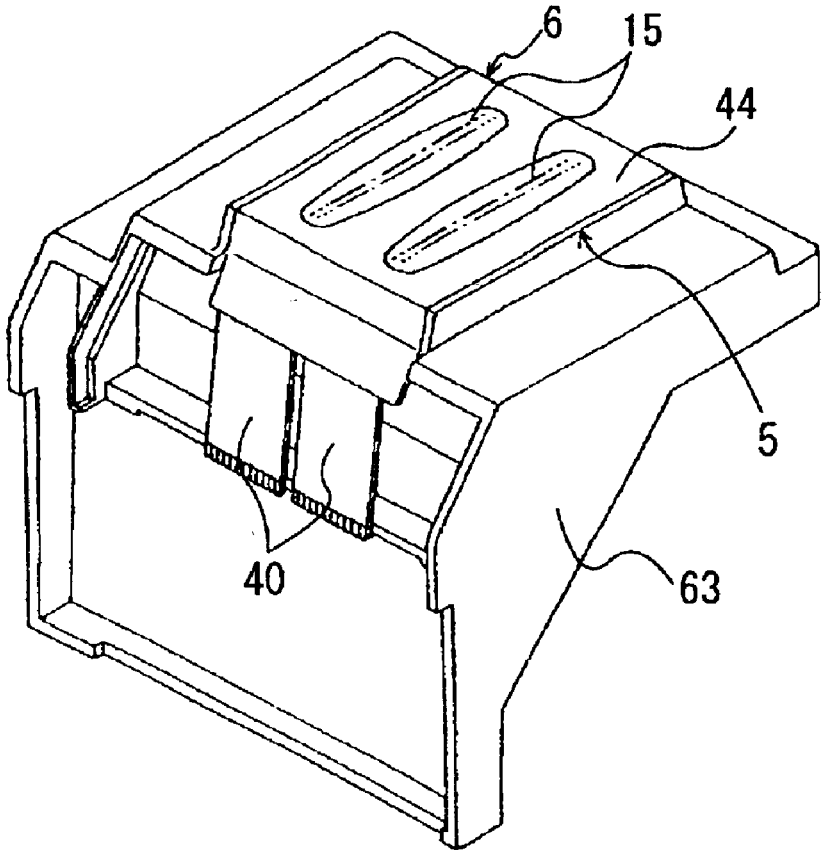
FIG. 2 is a perspective view of a head unit placed upside down.
Figure 3:
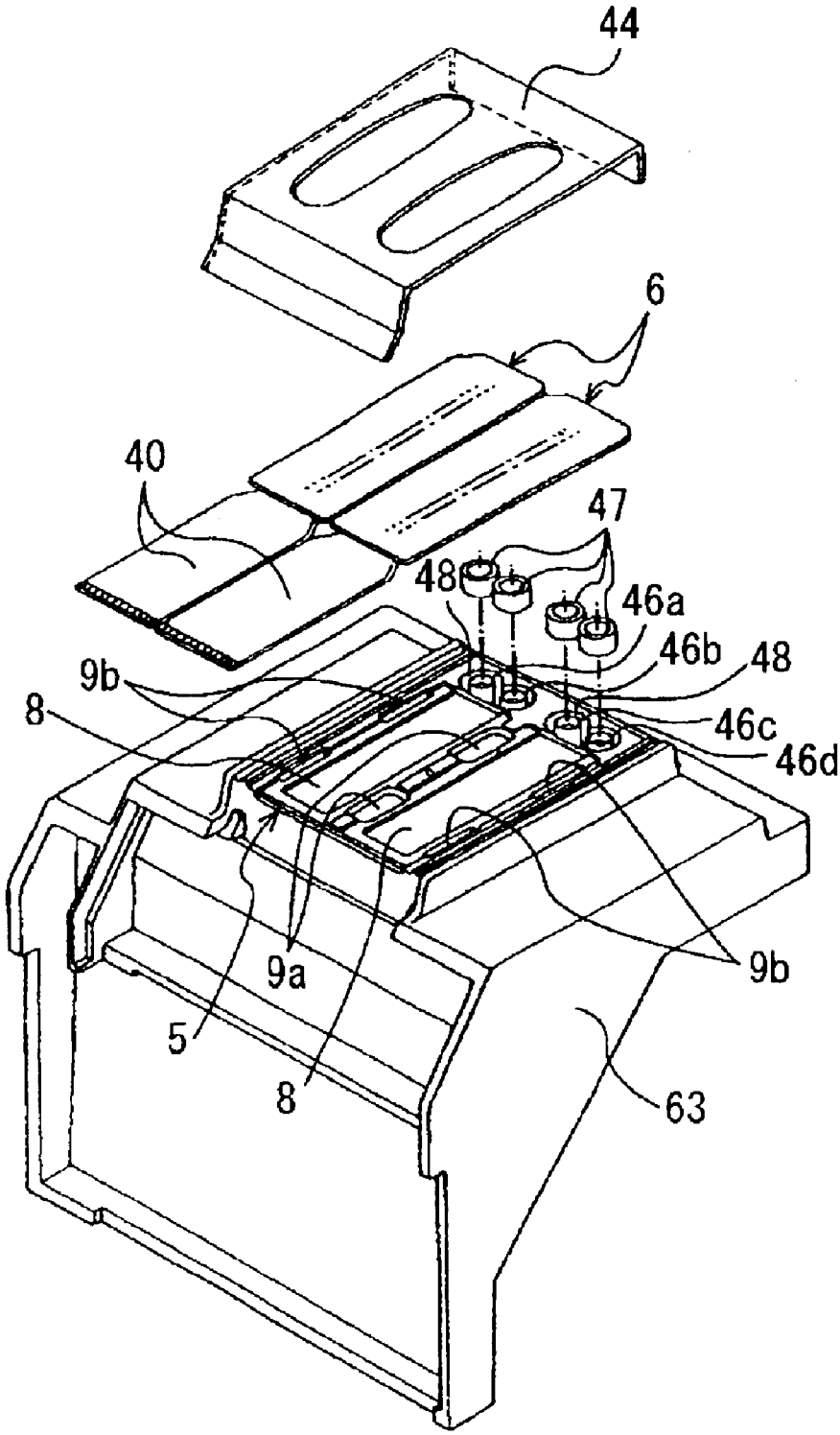
FIG. 3 is an exploded perspective view of the head unit of FIG. 2.
Figure 4:
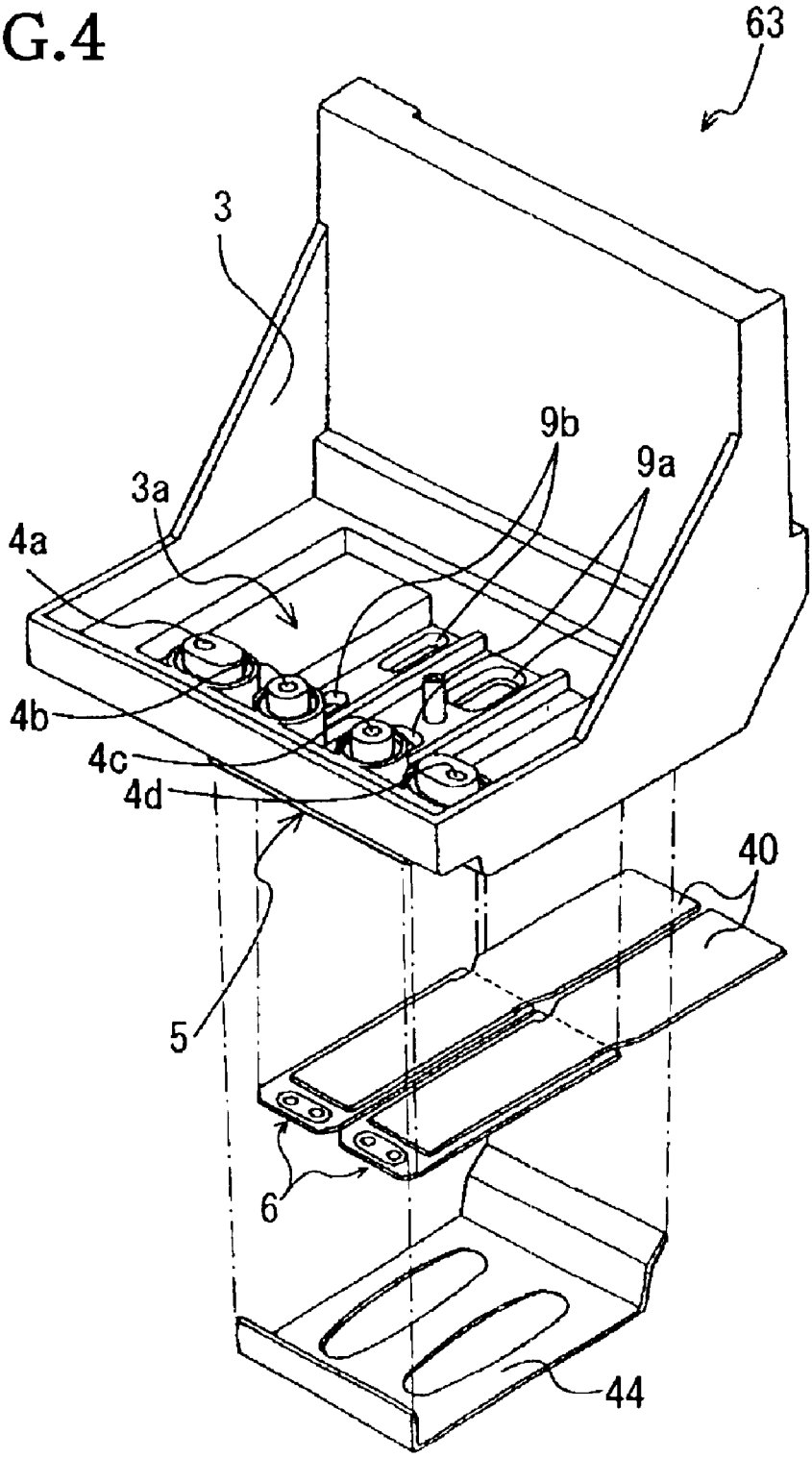
FIG. 4 is an exploded perspective view of the head unit as viewed from the top.
Figure 5:
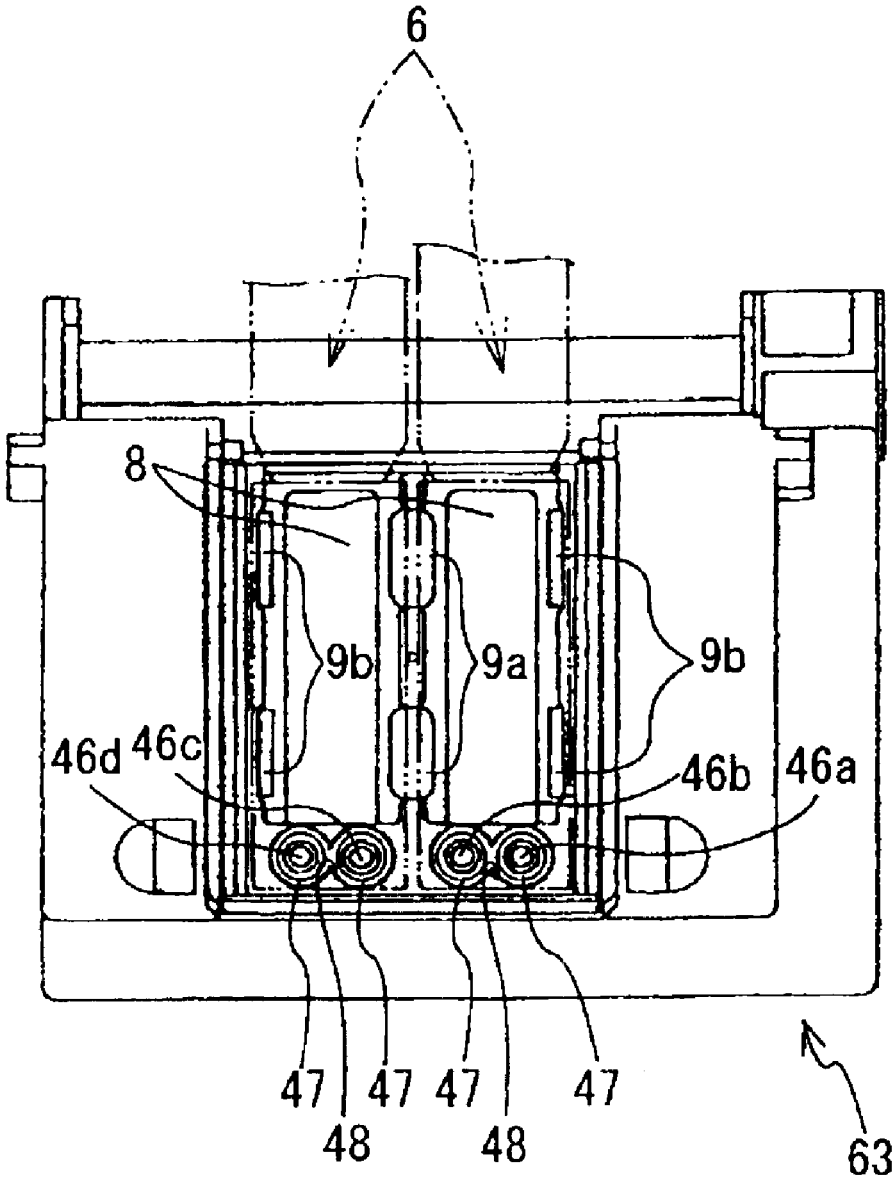
FIG. 5 is a bottom view of the head unit.

The head unit 63 will now be described with reference to FIGS. 2 through 5. FIG. 2 is a perspective view of the head unit 63 placed upside down. FIG. 3 is a exploded perspective view of the head unit 63. FIG. 4 is a exploded perspective view of the head unit 63 as viewed from the top. FIG. 5 is a bottom view of the head unit 63.

As shown in FIGS. 2 through 5, the head unit 63 to be mounted on the carriage 64, which moves along the sheet 62, is shaped like a box with its top surface open and has a cartridge mount 3 to which the four ink cartridges 61 are detachably attached. Ink supply passages 4*a*, 4*b*, 4*c*, 4*d* are provided at a side portion 3*a* of the cartridge mount 3 to reach the lower surface of a bottom plate 5 of the head unit 63. Rubber packings (not shown) are provided at the side portion 3*a* on the upper surface of the cartridge mount 3 so as to be hermetically connected to ink outlets (not shown) of the ink cartridges 61.

The bottom plate 5 projects downwardly from the cartridge mount 3 and extends horizontally. As shown in FIGS. 3 and 5, two stepped supports 8 are formed to receive two ink-jet heads 6 side by side. Openings 9*a*, 9*b* are formed in each support 8 to penetrate vertically therethrough, and an ultraviolet adhesive is applied to the openings 9*a*, 9*b* to bond the two ink-jet heads 6.

Communicating holes 46*a*, 46*b*, 46*c*, 46*d* are provided at one end of the supports 8 to communicate with the ink cartridges 61 through the ink supply passages 4*a*, 4*b*, 4*c*, 4*d*. Grooves 48 shaped like a figure eight as viewed from the top are provided around the communicating holes 46*a*, 46*b*, 46*c*, 46*d*. Ring-shaped packings 47 made of rubber or other materials are inserted into the grooves 48. When each ink-jet head 6 is bonded to the support 8, the packings 47 are press-fitted around the ink supply holes 19*a* (FIG. 8), thereby hermetically sealing the ink supply holes 19*a*.

A protective cover 44 is attached to the bottom plate 5 to cover the ink-jet heads 6 bonded to the bottom plate 5. The protective cover 44 is formed with two oval openings in its longitudinal direction such that the nozzles 15 are exposed through the openings. The protective cover 44 is folded at its both ends into an angular C shape, and is fixed to the head unit 63 such that a flexible flat cable 40 is folded upwardly along the folded portions of the protective cover 44.

Figure 6:
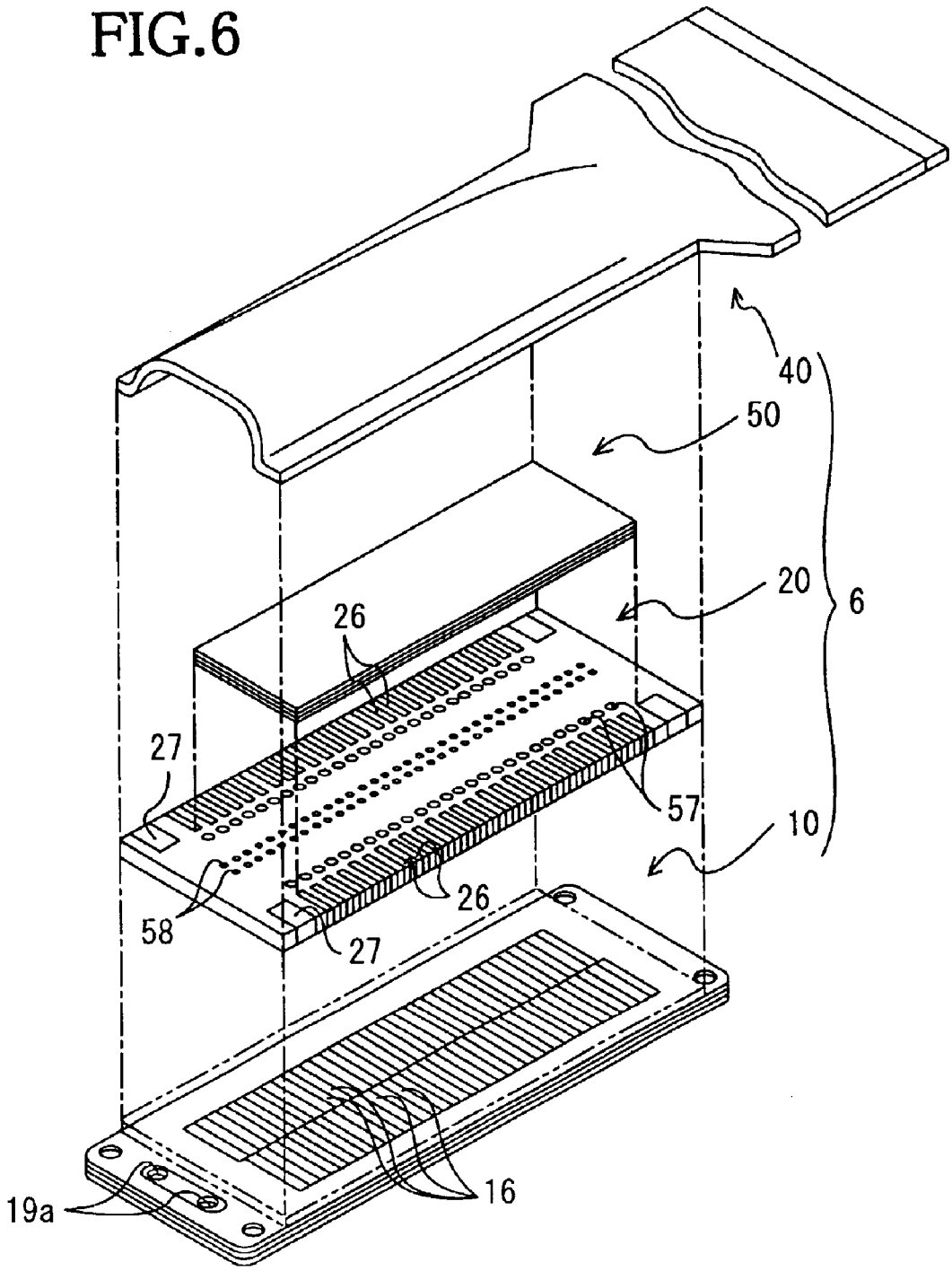
FIG. 6 is an exploded perspective view of the piezoelectric ink-jet head.
Figure 7:
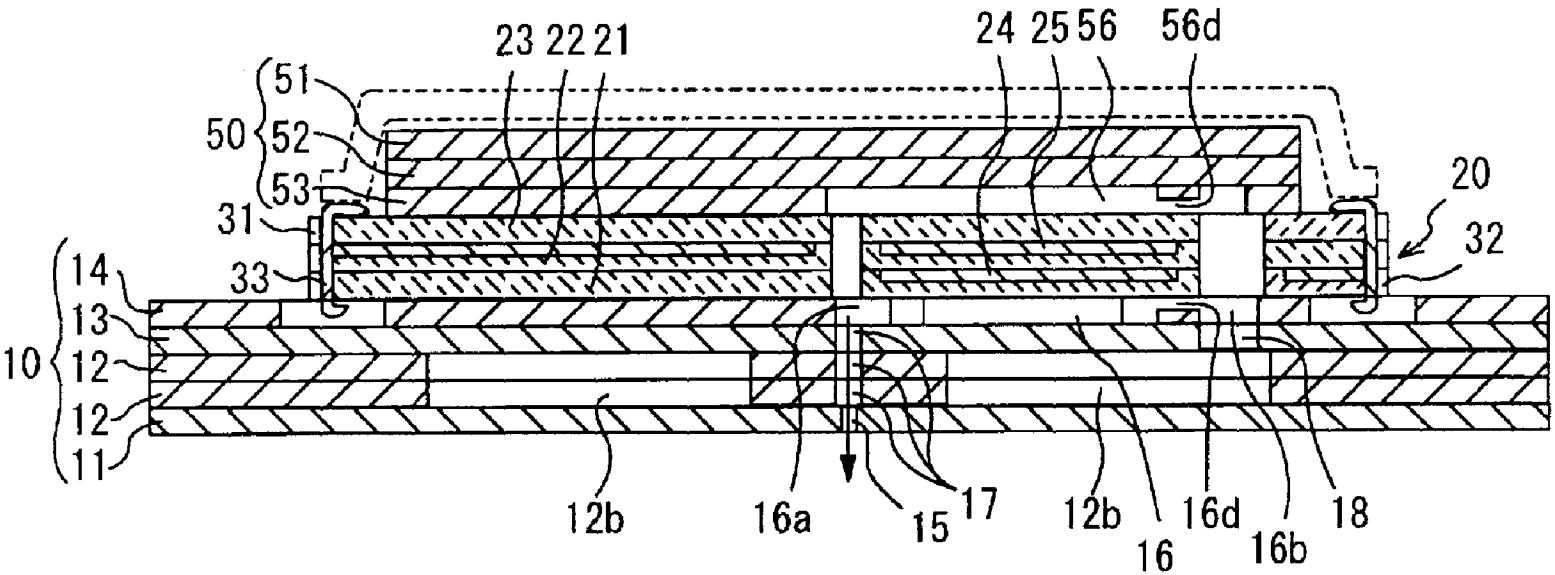
FIG. 7 is a side sectional view of the piezoelectric ink-jet head.
Figure 8:
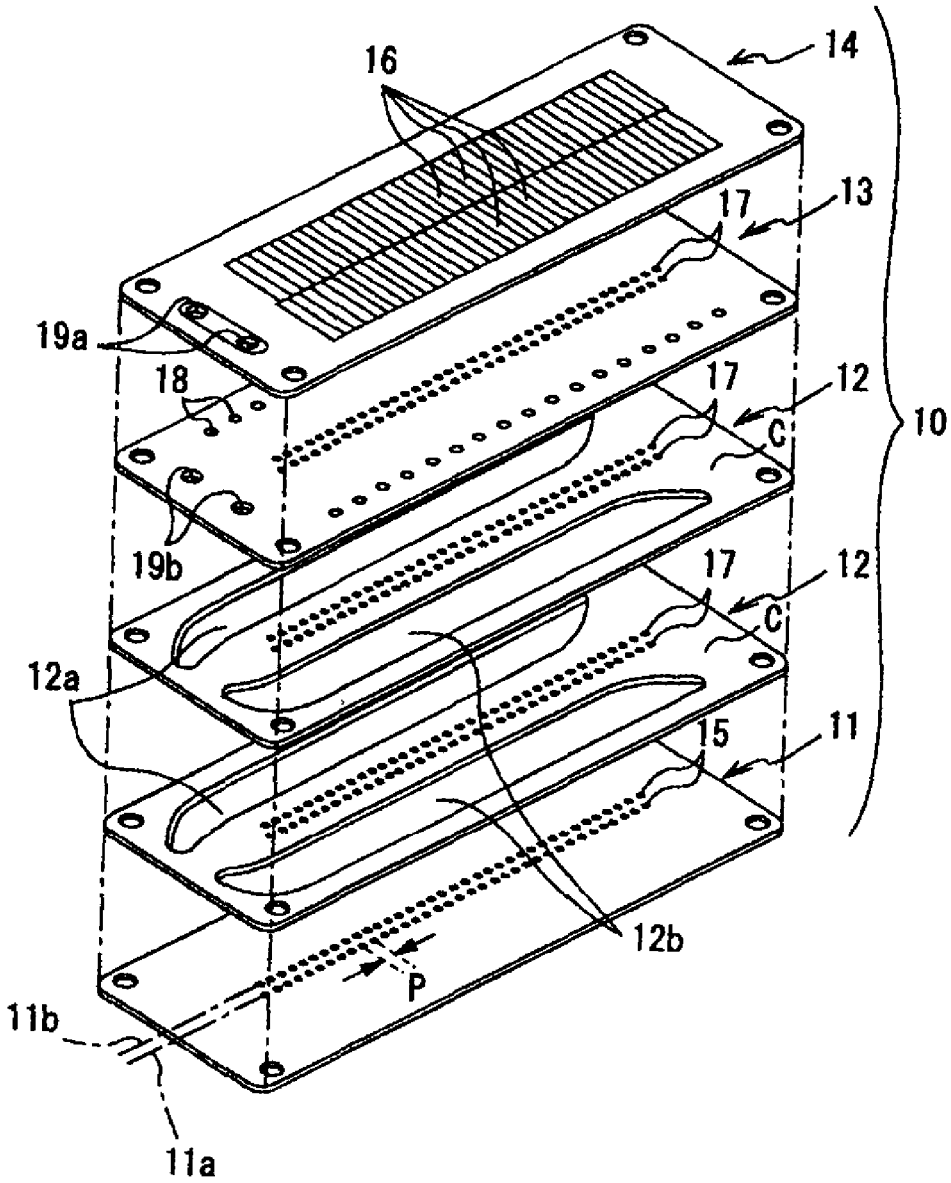
FIG. 8 is an exploded perspective view of a first cavity plate.
Figure 9:
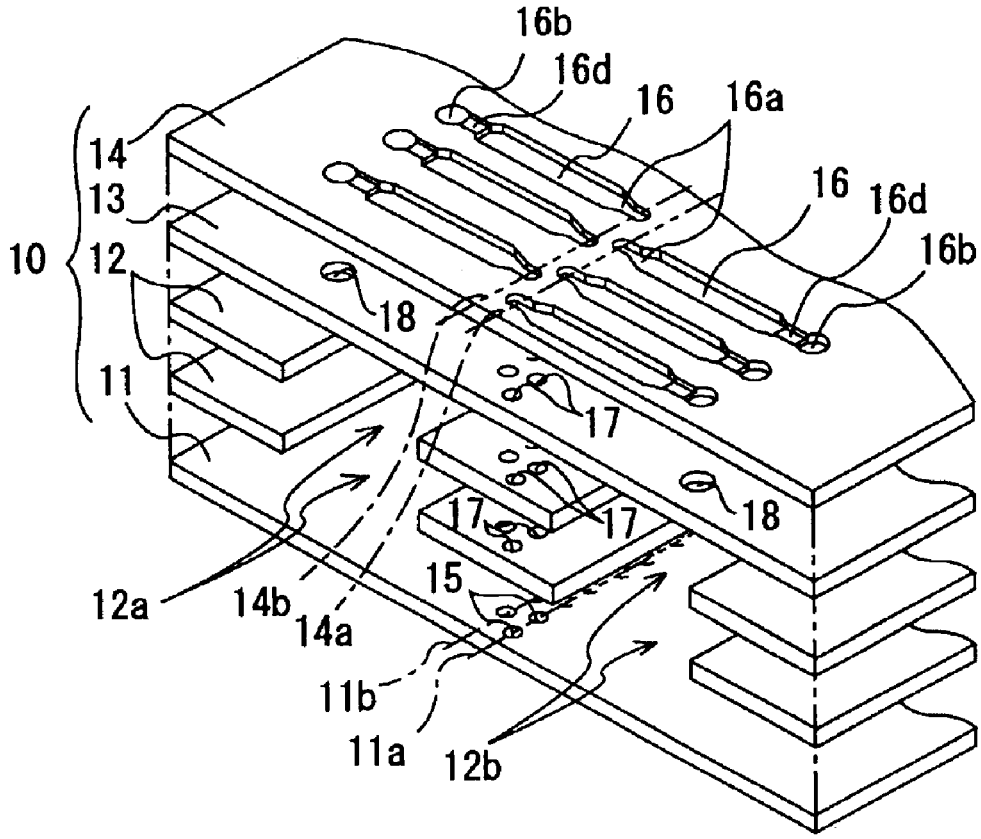
FIG. 9 is an enlarged exploded perspective view of substantial elements of the first cavity plate.
Figure 10:
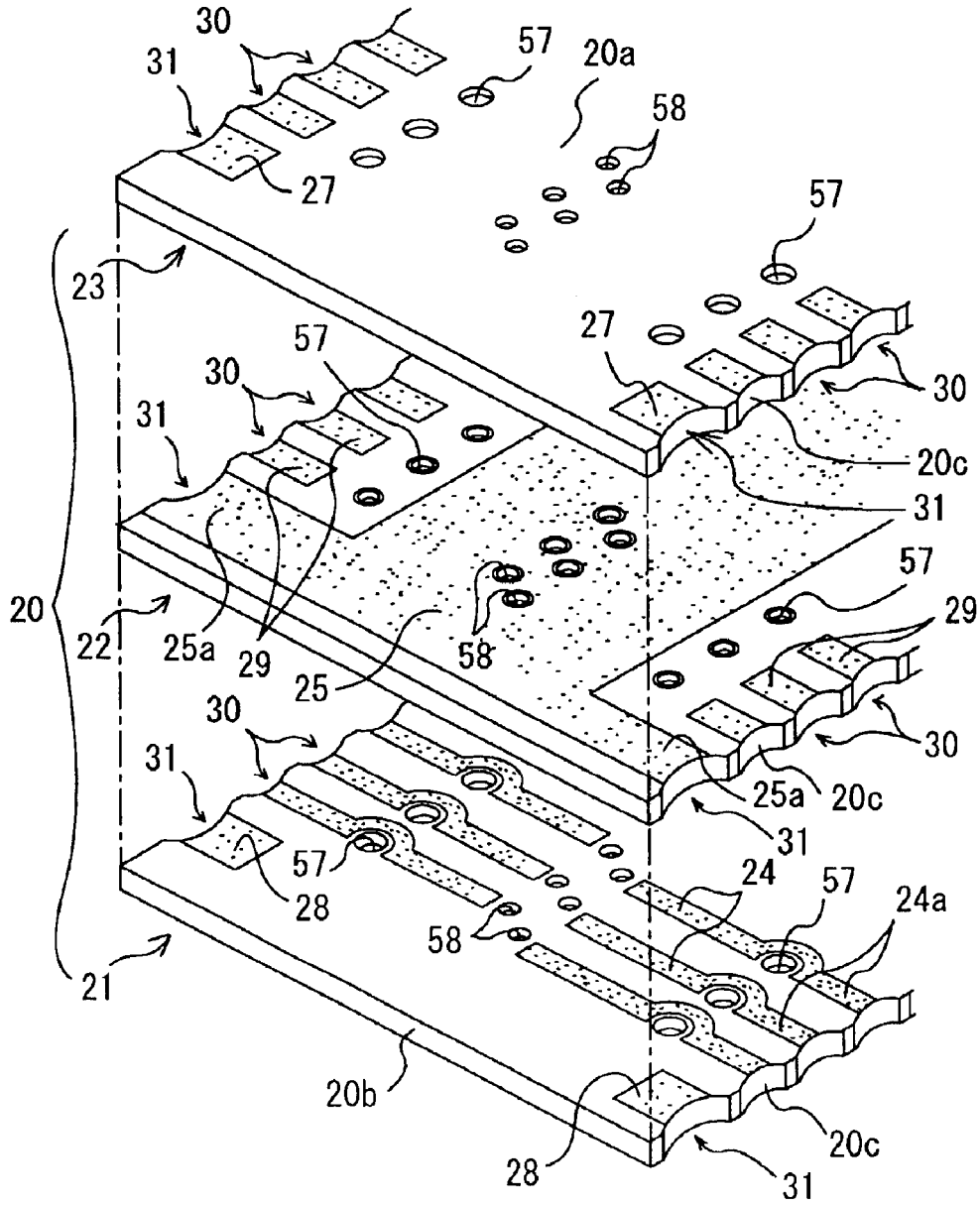
FIG. 10 is an enlarged view of substantial elements of a piezoelectric actuator.
Figure 11:
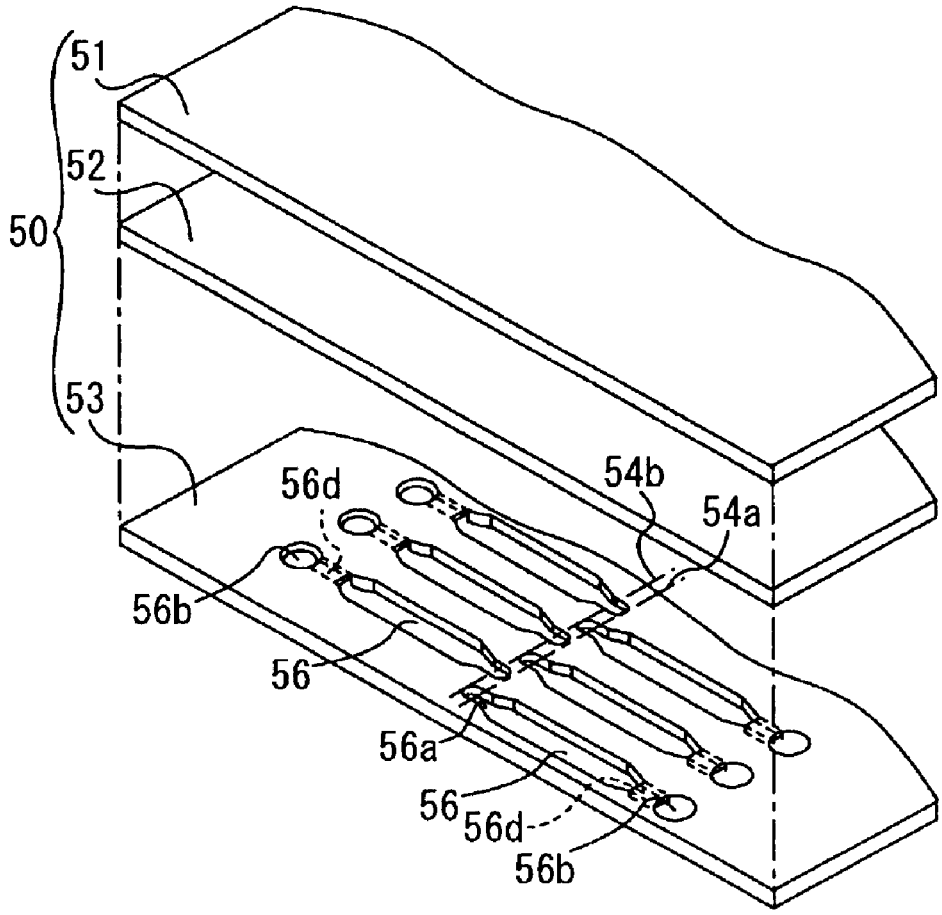
FIG. 11 is an enlarged exploded perspective view of substantial elements of a second cavity plate.

The structure of the piezoelectric ink-jet head 6 will now be described with reference to FIGS. 6 through 11. FIG. 6 is an exploded perspective view of the piezoelectric ink-jet head 6. FIG. 7 is a side sectional view of the piezoelectric ink-jet head 6. FIG. 8 is an exploded perspective view of a first cavity plate 10. FIG. 9 is an enlarged exploded perspective view of substantial elements of the first cavity plate 10. FIG. 10 is an enlarged exploded perspective view of substantial elements of the piezoelectric actuator 20. FIG. 11 is an enlarged exploded perspective view of substantial elements of a second cavity plate 50.

As shown in FIGS. 6 and 7, the piezoelectric ink-jet head 6 includes the first cavity plate 10, the second cavity plate 50, and the plate-like piezoelectric actuator 20 sandwiched between the first and second cavity plates 10, 50. The first and second cavity plates 10, 50 and the piezoelectric actuator 20 are stacked and bonded to each other. A flexible flat cable 40 is bonded using an adhesive to the upper surface of the ink-jet head 6. Ink is ejected downwardly from the nozzles 15 open at the lower surface of the first cavity plate 10 at the bottom.

As shown in FIG. 8, the first cavity plate 10 is formed by laminating five thin metal plates using an adhesive, that is, a nozzle plate 11, two manifold plates 12, a spacer plate 13, and a base plate 14. In this embodiment, these plates 11–14 are made of 42% nickel alloy (42 alloy) and each plate has a thickness of about 50 $\mu$m to 150 $\mu$m. These plates 11–14 may be made of resin, instead of metal.

As shown in FIG. 9, a plurality of first pressure chambers 16 are provided in a staggered configuration in the base plate 14. Each first pressure chamber 16 is narrow and extends perpendicularly to longitudinal center lines 14*a,* 14*b.* Ink supply holes 16*b* are provided at lateral ends of the base plate 14 so as to each correspond to one of the first pressure chambers 16. Restricting portions 16*d* are provided between the first pressure chambers 16 and the ink supply holes 16*b* such that each first pressure chamber 16 is connected to the corresponding ink supply hole 16*a* via the restricting portion 16*d.* The ink supply holes 16*b* communicate with either one of common ink chambers 12*a,* 12*b* in the manifold plate 12 via ink supply holes 18 formed at lateral ends of the spacer plate 13. The sectional area of the restricting portion 16*d* in the direction perpendicular to the ink flow direction is smaller than the sectional area of the first pressure chamber 16. With this structure, the resistance to the flow of ink passing from the first pressure chamber 16 to the ink supply hole 16*b* is increased, thereby preventing backflow of the ink from the first pressure chamber 16 to the ink supply hole 16*b.* An end portion 16*a* of each first pressure chamber 16 communicates with a corresponding one of the nozzles 15 formed in a staggered configuration in the nozzle plate 11, via a corresponding one of small-diameter through-holes 17 formed in a staggered configuration in the spacer plate 13 as well as in the two manifold plates 12.

As shown in FIG. 8, ink supply holes 19*a* and ink supply holes 19*b* are formed in the base plate 14 and the spacer plate 13, respectively, to supply ink from the ink cartridges 61 to the common ink chambers 12*a,* 12*b.* The common ink chambers 12*a,* 12*b* are provided in the plane parallel to the plane defined by the first pressure chambers 16 and placed closely to the nozzle plate 11 formed with the nozzles 15 than the base plate 14 formed with the first pressure chambers 16. The common ink chambers 12*a,* 12*b* are elongated in the nozzle array direction.

The sectional area of the common ink chambers 12*a,* 12*b* decreases at an end portion C gradually at a constant rate toward a direction away from the ink supply holes 19*a,* 19*b.* This prevents bubbles from being trapped in the end portion C. The common ink chambers 12*a,* 12*b* are scaled by stacking the nozzle plate 11 and the spacer plate 13 to sandwich the two manifold plates 12.

The ink ejection nozzles 15 having a very small diameter (about 25 μm in this embodiment) are formed in the nozzle plate 11 along the longitudinal center lines 11*a,* 11*b* with a small pitch P in a staggered configuration. The nozzles 15 are aligned with the corresponding through-holes in the two manifold plates 12.

As shown in FIG. 10, the piezoelectric actuator 20 is formed by laminating two piezoelectric sheets 21, 22 and an insulating sheet 23. A plurality of narrow drive electrodes 24 are provided, to correspond to the first pressure chambers 16, in a staggered configuration on the upper surface of the piezoelectric sheet 21 at the bottom. End portions 24*a* of the drive electrodes 24 are exposed to side surfaces 20*c,* which are perpendicular to top and bottom surfaces 20*a,* 20*b* of the piezoelectric actuator 20.

Figure 12:
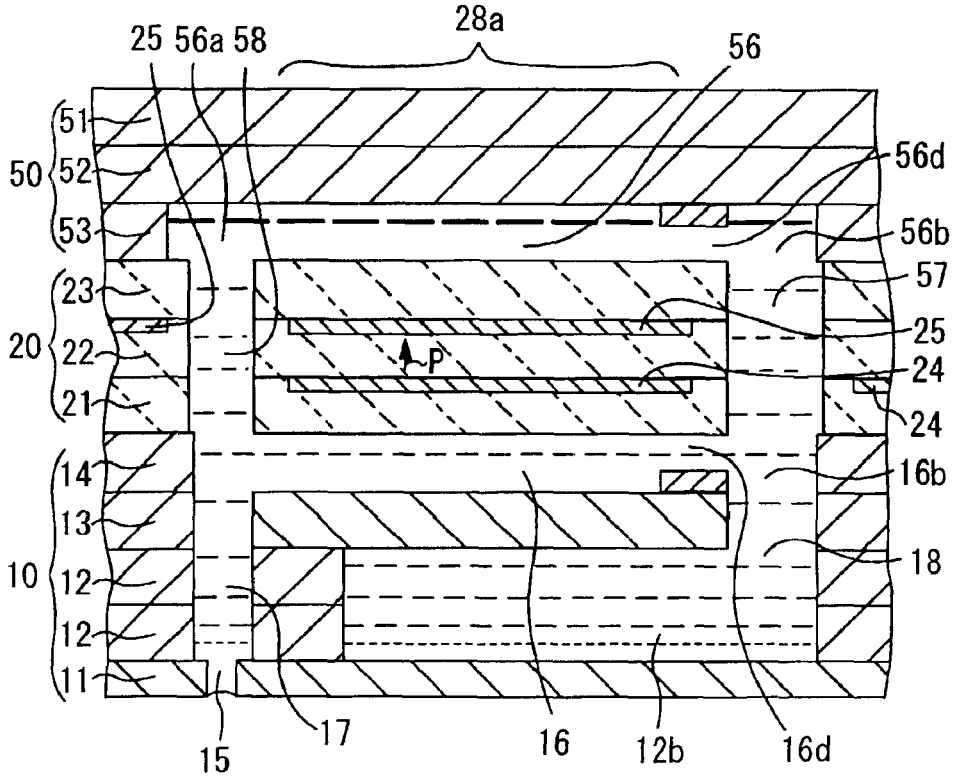
FIG. 12 is an enlarged sectional view of the piezoelectric ink-jet head of FIG. 7.

A common electrode 25 is provided on the upper surface of the piezoelectric sheet 22 in the middle. End potions 25*a* of the common electrode 25 are also exposed to the side surfaces 20*c.* Areas in the piezoelectric sheet 22 sandwiched by the drive electrodes 24 and the common electrodes 25 constitute pressure generating portions 28*a,* which correspond to the first pressure chambers 16. As shown in FIG. 12, each pressure generating portion 28*a* is polarized in direction P from the drive electrode 24 toward the common electrode 25.

Surface electrodes 26 corresponding to the drive electrodes 24 and surface electrodes 27 corresponding to the end portions 25*a* of the common electrode 25 are provided along the side surfaces 20*c.* First recesses 30 are formed at the end portions 24*a* of the drive electrodes 24 so as to extend in the laminating direction, and second recesses 31 are formed at the end portions 25*a* of the common electrode 25 so as to extend in the laminating direction. As shown in FIG. 7, a side electrode 32 is provided in each first recess 30 to electrically connect the corresponding drive electrode 24 and surface electrode 26, and a side electrode 33 is provided in each second recess 31 to electrically connect the common electrode 25 and the corresponding surface electrode 27. Electrodes 28, 29 are dummy electrodes that are electrically connected to the end portions 25*a* of the common electrode 25 and the drive electrodes 24, respectively.

Outer holes 57 and inner holes 58 are formed as many as the first pressure chambers to penetrate the piezoelectric actuator 20 vertically by laser machining or other methods. The outer holes 57 are aligned with the ink supply holes 16*b* of the first pressure chambers 16, and the inner holes 58 are aligned with the end portions 16*a* of the first pressure chambers 16. The drive electrodes 24 and the common electrode 25 are formed around the outer and inner holes 57, 58 so as not to contact ink and cause a short circuit between the electrodes 24, 25.

As shown in FIG. 11, the second cavity plate 50 is formed by laminating three thin metal plates using an adhesive, that is, two spacer plates 51, 52 and a base plate 53. In this embodiment, these plates 51–53 are made of 42% nickel alloy (42 alloy), similar to the first cavity plate 10, and each plate has a thickness of about 50 μm to 150 μm. These plates 51–53 may be made of resin, instead of metal.

A plurality of second pressure chambers 56 are provided in a staggered configuration in the base plate 53. Each second pressure chamber 56 is narrow and extends perpendicularly to longitudinal center lines 54*a,* 54*b.* Ink supply holes 56*a* are provided for the second pressure chambers 56 at lateral ends of the base plate 53. Recessed restricting portions 56*d* are provided between the second pressure chambers 56 and the ink supply holes 56*b* such that each second pressure chamber 56 is connected to the corresponding ink supply hole 56*b* via a restricting portion 56*d.* Each ink supply hole 56*b* communicate with an ink supply hole 16*b* of the corresponding first pressure chamber 16 via the corresponding outer hole 57 formed in the piezoelectric actuator 20. The sectional area of the restricting portion 56*d* in the direction perpendicular to the ink flow direction is smaller than the sectional area of the second pressure chamber 56. With this structure, the resistance to the flow of ink passing from the second pressure chamber 56 to the ink supply hole 56*b* is increased, thereby preventing backflow of the ink from the second pressure chamber 56 to the ink supply hole 56*b.* An end portion 56*a* of each second pressure chamber 56 communicates with an end portion 16*a* of the corresponding first pressure chamber 16 via the corresponding inner hole 58 formed in the piezoelectric actuator 20.

The piezoelectric ink-jet head 6 is formed by sandwiching the piezoelectric actuator 20 between the first and second cavity plates 10, 50. When the first and second cavity plates 10, 50 and the piezoelectric actuator 20 are stacked, each first pressure chamber 16 and the corresponding second pressure chamber 56, pressure generating portion 28*a,* and common ink chamber 12*a* or 12*b* are aligned substantially vertically, that is, perpendicularly to the actuator extending direction.

The piezoelectric actuator 20 is sandwiched between the first and second cavity plates 10, 50 that are made of the same metal and have the same linear expansion coefficient. Thus, the piezoelectric ink-jet head 6 is less likely to bend during assembly where the first and second cavity plates 10, 50 are thermally bonded to the piezoelectric actuator 20 using a thermosetting adhesive, or during printing operation that involves temperature changes. The first and second cavity plates 10, 50 are not necessarily made of metal, as described above. However, if the first and second cavity plates 10, 50 are made of a material having the same linear expansion coefficient, the same effect is obtained and the resultant piezoelectric ink-jet head 6 is less likely to bend even when the temperature changes.

The flow of ink in the piezoelectric ink-jet head 6 will now be described briefly. Ink flows from the ink cartridge 61 into the common ink chamber 12*a* or 12*b* via the ink supply holes 19*a,* 19*b* formed at one end of the base plate 14 and the spacer plate 13. The ink in the common ink chamber 12*a* or 12*b* flows into each first pressure chamber 16 via the corresponding ink supply hole 16*b* and restricting portion 16*d.* As a branch flow, the ink flowing into each ink supply hole 16*b* further flows into the corresponding second pressure chamber 56 via the corresponding outer hole 57, ink supply hole 56*b* and restricting portion 56*d.* The ink in each second pressure chamber 56 flows toward the corresponding end portion 56*a,* passes the corresponding inner hole 58, and joins into the main flow at the end portion 16*a* of the corresponding first pressure chamber 16. Then, the ink passes through the corresponding through-hole 17 and reaches the corresponding nozzle 15.

FIG. 12 is an enlarged sectional view of the piezoelectric ink-jet head 6 of FIG. 7 and shows a state where the common ink chamber 12*b* and the first and second pressure chambers 16, 56 are filled with ink.

Figure 13:
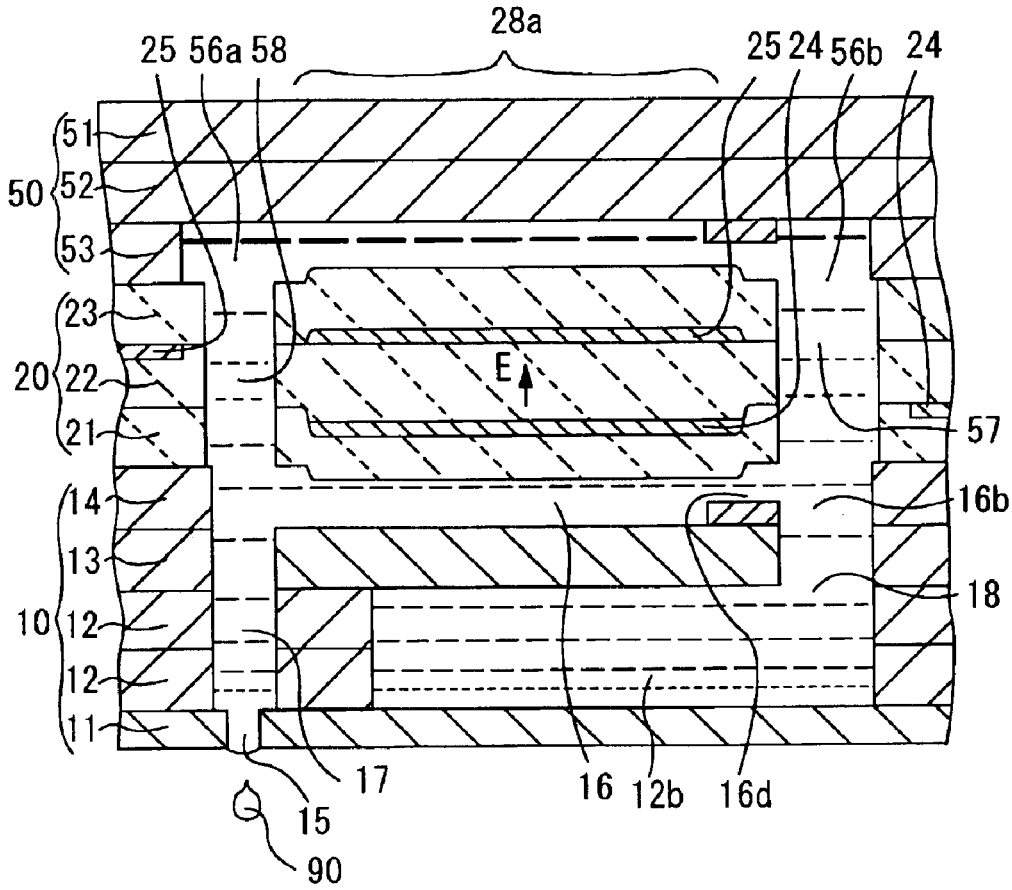
FIG. 13 is an enlarged sectional view showing the operation of the piezoelectric ink-jet head.
Figure 14:
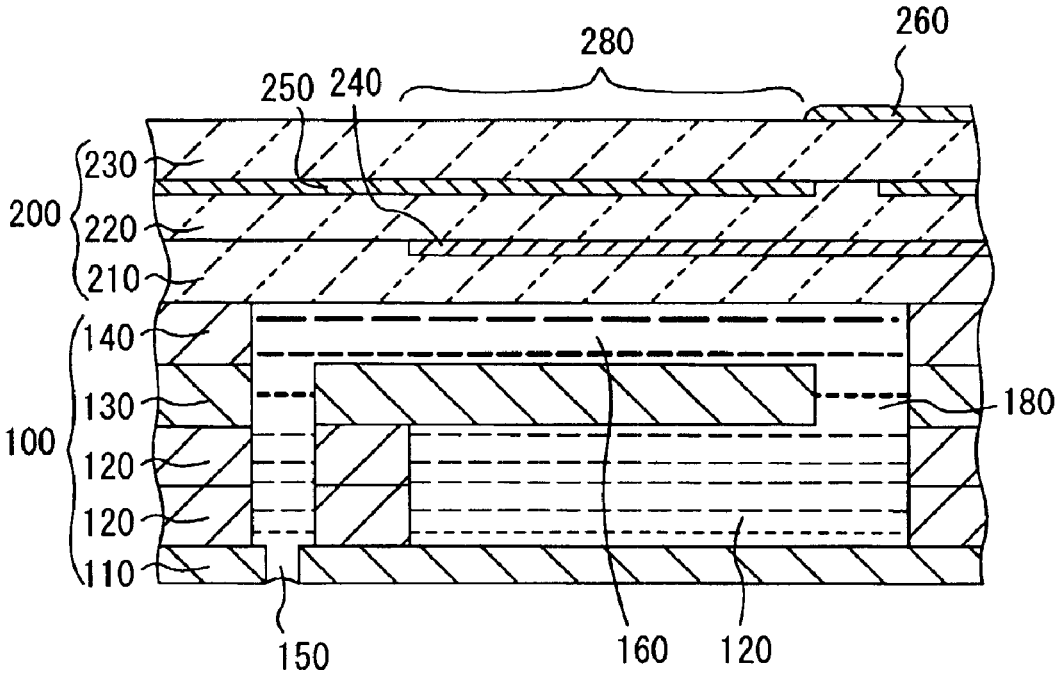
FIG.14 RELATED ART
FIG. 14 is an enlarged sectional view of a conventional piezoelectric ink-jet head.

As shown in FIG. 13, in the piezoelectric ink-jet head 6, when a positive voltage is applied to any one of the drive electrodes 24 of the piezoelectric actuator 20 while the common electrode 25 is grounded, an electrical field E is generated in the same direction as the polarization direction P in the pressure generating portion 28*a* between the drive electrode 24 and the common electrode 25. Consequently, the pressure generating portion 28*a* of the piezoelectric sheet 22 expands in the laminating direction by a piezoelectric longitudinal effect.

The pressure generating portion 28*a* expands toward both sides of the piezoelectric actuator 20, that is, toward the first pressure chamber 16 and the second pressure chamber 56 to reduce the volume of the first and second pressure chambers 16, 56 and increase the internal pressure of the first and second pressure chambers 16, 56. As a result, ink flows through the inner holes 58 toward the nozzle 15 and an ink droplet 90 is ejected from the nozzle 15.

In the piezoelectric ink-jet head 6 of the above-described embodiment, upward and downward deformation of the pressure generating portion 28*a* of the piezoelectric actuator 20 effectively applies pressure on the ink in the first and second pressure chambers 16, 56 formed on both sides of the piezoelectric actuator 20. Thus, the pressure generating portion 28*a* can be driven with a relatively low voltage using a less costly power source than in a conventional ink-jet head. If the drive voltage required for a conventional ink-jet head is used, the area of the pressure generating portion 28*a,* as well as the capacitance of the pressure generating portion 28*a,* can be reduced.

The pressure generating portion 28*a* deforms symmetrically toward upper and lower sides of the piezoelectric actuator 20. The first pressure chamber 16 faces the upper side of piezoelectric actuator 20 while the second pressure chamber 56 faces the lower side of the piezoelectric actuator 20. Thus, the deformation of the pressure generating portion 28*a* acts on the first and second pressure chambers 16, 56 effectively, with a less deformation loss than in a conventional ink-jet head, and the ink is ejected from the corresponding nozzle 15 that communicates with both the first and second pressure chambers 16, 56.

In addition, the piezoelectric ink-jet head 6 is easily formed by sandwiching the piezoelectric actuator 20 between the first and second cavity plates 10, 50. Because the first and second cavity plates 10, 50 are made of the same metal and have the same linear expansion coefficient, the piezoelectric ink-jet head 6 is less likely to bend during assembling and bonding using heat treatment or during printing operation that involves temperature changes. Accordingly, positional shifts of dots are prevented, and high print quality is maintained.

Further, the ink passages to and from the first and second pressure chambers 16, 56 are defined and directed appropriately by the holes provided at both longitudinal ends of the first and second pressure chambers 16, 56. Ink is supplied to the first and second pressure chambers 16, 56 through the holes provided at one of the longitudinal ends, and ink is discharged from the first and second pressure chambers 15 through the holes provided at the other longitudinal end to the corresponding nozzle 15, effectively.

Further, a plurality of ink ejecting mechanisms formed by a plurality of pressure generating portions 28*a* and a plurality of pairs of pressure chambers 16, 56 are integrated into a plate-shaped ink-jet head 6. Each pressure generating portion 28*a* is provided between a corresponding one of the first ink chambers 15 and a corresponding one of the second ink chambers 56. Thus, the piezoelectric ink-jet head 6 can accomplish high-resolution printing. Whereas, in the above-described embodiment, the pressure generating portion 28*a* is controlled to expand upon the application of a voltage, the pressure generating portion 28*a* may be controlled to contract upon the application of a voltage by reversing the polarization direction P and the direction of the electric field E. In this case, the pressure generating portion 28*a* contracts to cause pressure change in the first and second pressure chambers 16, 56 and returns to the original state to pressurize the ink and cause ink ejection.

Alternatively, a voltage may be applied to the pressure generating portion 28*a* constantly when ink is not ejected. In this case, the volume of the first and second pressure chambers 16, 56 is kept reduced normally, and the voltage applied to the pressure generating portion 28*a* is released upon the input of an ejection signal to increase the volume of the first and second pressure chambers 16, 56. Then, the voltage is applied again to pressurize the ink to cause ink ejection.

While the invention has been described with reference to the specific embodiment, the description of the embodiment is illustrative only and is not to be construed as limiting the scope of the invention. Various other modifications and changes may be possible to those skilled in the art without departing from the spirit and scope of the invention.

What is claimed is:

1. An ink ejecting device comprising:

a nozzle from which ink is ejected;

an actuator having a pressure generation portion between its opposed surfaces, the pressure generating portion being deformable to shift the opposed surfaces of the actuator substantially symmetrically;

a first pressure chamber that stores the ink and is disposed to face one of the opposed surfaces of the actuator;

a second pressure chamber that stores the ink and is disposed to face the other surface of the actuator;

wherein the first and second pressure chambers communicate with each other and also communicate with the nozzle; and wherein the first and second pressure chambers communicate with each other via first and second through-holes formed in the actuator, and the second through-hole leads to the nozzle.

2. The ink ejecting device according to claim 1, wherein the actuator includes a piezoelectric member and a pair of electrodes disposed in the piezoelectric member, and the pressure generating portion is defined between the pair of electrodes and is polarized in an opposing direction of the pair of electrodes, and upon application of a voltage to the pair of electrodes, the pressure generating portion expands to shift the opposed surfaces of the actuator.

3. The ink ejecting device according to claim 1, wherein the first and second pressure chambers are connected, at their one longitudinal end, with the first through-hole and connected, at their other longitudinal end, with the second thorough-hole, and the pressure generating portion of the actuator is defined between the first and second through-holes.

4. The ink ejecting device according to claim 3, wherein the first pressure chamber is formed in a first cavity plate while the second pressure chamber is formed in a second cavity plate, and the nozzle is formed in one of the first and second cavity plates, the first and second cavity plates being stacked to sandwich the actuator therebetween.

5. The ink ejecting device according to claim 4, wherein the first and second cavity plates have substantially the same linear expansion coefficient.

6. The ink ejecting device according to claim 4, wherein the first cavity plate is placed on one side of the actuator while the second cavity plate is placed on the other side of the actuator, and the first cavity plate is formed with the nozzle and a common ink chamber that supplies the ink to the first pressure chamber as well as to the second pressure chamber through the first through-hole.

7. The ink ejecting device according to claim 6, wherein the first cavity plate is formed with a restricting portion at one longitudinal end of the first pressure chamber to increase resistance to flow of the ink in the first pressure chamber toward its one longitudinal end than toward its other longitudinal end, and the second cavity plate is formed with a restricting portion at one longitudinal end of the second pressure chamber to increase resistance to flow of the ink in the second pressure chamber toward its one longitudinal end than toward its other longitudinal end.

8. The ink ejecting device according to claim 1, wherein when the pressure generating portion deforms to shift the two opposed surfaces of the actuator, the ink in the first pressure chamber flows toward the nozzle, and the ink in the second pressure chamber flows through the second through-hole toward the nozzle.

9. The ink ejecting device according to claim 1, further comprising a common ink chamber that supplies the ink to the first and second pressure chambers, wherein the first through-hole leads to the common ink chamber.

10. The ink ejecting device according to claim 9, wherein the first and second pressure chambers communicate, at their one end, with the common ink chamber and communicate, at their other end, with the nozzle, and the first and second pressure chambers each have, at their one end, a portion that increases resistance to flow of the ink in the first and second pressure chambers toward the common ink chamber than toward the nozzle.

11. The ink ejecting device according to claim 9, wherein the first pressure chamber, the second pressure chamber, and the common ink chamber are formed in first, second, and third plates, respectively, and the first and second plates are stacked to sandwich the actuator while the third plate is stacked on an opposite side of one of the first and second plates from the actuator.

12. An ink ejecting device comprising:

a first cavity plate formed with an array of first pressure chambers storing ink;

a second cavity plate formed with an array of second pressure chambers storing the ink;

an array of nozzles formed in one of the first and second cavity plates to eject ink therefrom;

an actuator disposed between the first and second cavity plates and having pressure generating portions between its opposed surfaces, each pressure generating portion being provided for one of the first pressure chambers and one of the second pressure chambers and being deformable to shift the opposed surfaces of the actuator partially and substantially symmetrically;

wherein the first pressure chambers face one of the opposed surfaces of the actuator while the second chambers face the other surface, and each first pressure chamber and a corresponding one of the second pressure chambers communicate with each other and also communicate with a corresponding one of the nozzles; and wherein the first pressure chamber and the corresponding one of the second pressure chambers communicate with each other via first and second through-holes formed in the actuator, and the second thorough-hole leads to the corresponding one of the nozzles.

13. The ink ejecting device according to claim 12, wherein the actuator includes a piezoelectric member and pairs of electrodes disposed in the piezoelectric member, and each pressure generating potion is defined between a corresponding pair of electrodes and polarized in an opposing direction of the pair of electrodes, and upon application of a voltage to the pair of electrodes, the pressure generating portion expands to shift the opposed surfaces of the actuator.

14. The ink ejecting device according to claim 12, wherein the first and second cavity plates have substantially the same linear expansion coefficient.

15. The ink ejecting device according to claim 12, wherein the first pressure chamber and the corresponding one of the second pressure chambers are connected, at their one longitudinal end, with the first through-hole and connected, at their other longitudinal end, with the second through-hole, and a corresponding one of the pressure generating portions is defined between the first and second through-holes.

16. The ink ejecting device according to claim 12, further comprising a common ink chamber formed in one of the first and second cavity plates to supply the ink to the first and second pressure chambers, wherein the first through-hole leads to the common ink chamber.

17. The ink ejecting device according to claim 16, wherein one of the first and second cavity plates formed with the common ink chamber is formed by stacking a plurality of plates that include a plate formed with the array of first or second pressure chambers and a plate formed with the common ink chamber, the plate formed with the common ink chamber being placed on an opposite side of the plate formed with the array of first or second pressure chambers from the actuator.

18. An ink ejecting device comprising:

a first cavity plate including:

a common ink chamber that stores ink; and a first pressure chamber that receives the ink from the common ink chamber;

a second cavity plate having a second pressure chamber that receives the ink from the common ink chamber;

an actuator having a deformable portion and disposed between the first and second cavity plates such that the deformable portion is placed between the first and second pressure chambers;

a first ink passage that communicates with the common ink chamber and the first and second pressure chambers;

a nozzle from which the ink is ejected, and a second ink passage that communicates with the first and second pressure chambers and the nozzle.

19. The ink ejecting device according to claim 18, wherein the first and second ink passages pass through the actuator to sandwich the deformable portion.

20. The ink ejecting device according to claim 19, wherein the second cavity plate is placed on one side of the actuator while the first cavity plate is placed on the other side of the actuator, and the common ink chamber, the first pressure chamber, the deformable portion, and the second pressure chamber are aligned substantially perpendicularly to an actuator extending direction.

21. The ink ejecting device according to claim 20, wherein the first ink passage runs from the common ink chamber, through the actuator, to the second pressure chamber substantially perpendicularly to the actuator extending direction and communicates, between the common ink chamber and the actuator, with the first pressure chamber, and the second ink passage runs from the second pressure chamber, through the actuator, to the nozzle substantially perpendicularly to the actuator extending direction and communicates, between the nozzle and the actuator, with the first pressure chamber.

22. The ink ejecting device according to claim 19, wherein when the deformable portion deforms toward the first and second pressure chambers substantially symmetrically, the ink in the first and second pressure chamber is pressurized to flow through the second ink passage and is ejected from the nozzle.

23. An ink ejecting device comprising:

a nozzle from which ink is ejected;

an actuator having first and second opposing surfaces, the actuator being operable to shift the first and second surfaces substantially symmetrically;

a first pressure chamber that stores the ink and is disposed to face the first surface of the actuator; and a second pressure chamber that stores the ink and is disposed to face the second surface of the actuator;

the actuator having a through-hole through which the ink passes, the through hole being in communication with the nozzle and with the first and second pressure chambers.

24. The ink ejecting device according to claim 23, wherein when a voltage is applied to the actuator, the first surface expands to pressurize the ink in the first pressure chamber to push the ink through the nozzle and the second surface expands to pressurize the ink in the second pressure chamber to push the ink through the through-hole and the nozzle.

25. The ink ejecting device according to claim 23, further comprising:

a first cavity plate containing the first pressure chamber and being attached to the first surface of the actuator; and a second cavity plate containing the second pressure chamber and being attached to the second surface of the actuator;

the first and second cavity plates having substantially the same linear expansion coefficient.

26. The ink ejecting device according to claim 23, wherein the actuator includes:

first and second opposing electrodes; and a pressure generating portion between the first and second opposing electrodes, wherein when a voltage is applied between the first and second electrodes, the pressure generating portion expands to substantially symmetrically and simultaneously expand the first and second opposing surfaces of the actuator.

27. A method of ejecting ink from an ink ejecting device including a nozzle, an actuator having first and second opposing surfaces, first and second pressure chambers that store the ink and are respectively disposed to face the first and second opposing surfaces of the actuator, the method comprising:

applying a first voltage to the actuator to substantially symmetrically and simultaneously expand the first and second opposing surfaces such that the expanded first surface pressurizes the ink in the first pressure chamber to push the ink through the nozzle and the expanded second surface pressurizes the ink in the second pressure chamber to push the ink through a through-hole in the actuator and the nozzle.

28. The method according to claim 27, further comprising applying a second voltage to the actuator to substantially symmetrically and simultaneously contract the first and second opposing surfaces to reduce the pressure in the first and second pressure chambers so as to restore the ink in the respective first and second pressure chambers from an ink source.

* * * * *